US005408174A

United States Patent [19]

Leonowich

[11] Patent Number: 5,408,174

[45] Date of Patent: Apr. 18, 1995

[54] SWITCHED CAPACITOR CURRENT REFERENCE

[75] Inventor: Robert H. Leonowich, Temple

[73] Assignee: AT&T Corp., Murray Hill, N.J.

[21] Appl. No.: 82,690

[22] Filed: Jun. 25, 1993

[51] Int. Cl.[6] ..... G05F 3/26

[52] U.S. Cl. ..... 323/315; 323/316; 323/907

[58] Field of Search ..... 323/312, 907, 314, 315, 323/313; 307/296.3, 491, 493

[56] References Cited

U.S. PATENT DOCUMENTS 4,484,089 11/1984 Viswanathan ..... 307/297
4,520,283 5/1985 Sasaki et al. ..... 307/520
4,521,743 6/1985 Heimer ..... 330/296
4,714,843 12/1987 Smith ..... 307/491
4,970,415 11/1990 Fitzpatrick et al. ..... 307/448
5,124,593 6/1992 Michel ..... 307/521
5,166,630 11/1992 Lee ..... 328/167
5,168,179 12/1992 Negahban-Hagh ..... 307/491

*Primary Examiner*—Steven L. Stephan
*Assistant Examiner*—Adolf Berhane
*Attorney, Agent, or Firm*—Scott W. McLellan

[57] ABSTRACT

A current reference using a switched capacitor to produce a substantially temperature invariant output current. Charge subtracted from a relatively large capacitor by a much smaller switched capacitor at a chosen rate substantially determines the output current of the reference. The output current is proportional to the product of a reference voltage, the capacitance of the switched capacitor and the switching frequency.

10 Claims, 1 Drawing Sheet

SWITCHED CAPACITOR CURRENT REFERENCE

BACKGROUND OF THE INVENTION

1. Field of the Invention

This invention relates to current references and switched capacitor circuits in general and, more particularly, to substantially temperature independent MOS current reference.

2. Description of the Prior Art

Implementing temperature independent current references in bipolar technology is well known. See "Analog Integrated Circuits", 2nd edition, by Gray and Meyer, pp. 284–296. However, for MOS circuits where bipolar transistors are not available or undesired, current references are more difficult to make with a low temperature coefficient. The most common form of current reference mirrors the current through a resistor coupled to a relatively temperature independent voltage reference (e.g., a bandgap reference). See pages 730–737 of the above-mentioned reference. The temperature dependence of the current through the resistor is then substantially determined by the temperature coefficient of the resistor. If the resistor is an integrated circuit resistor, the temperature coefficient thereof can be very substantial: about −2000 ppm/° C. or so. This may be intolerable in certain applications. Thus, either the resistor is made to be off-chip (thereby having a well-defined temperature coefficient) or the temperature coefficient of the voltage reference is designed to partially offset the temperature coefficient of the resistor. In either case, the result may be impractical or not of sufficient tolerance for the desired application.

It is therefore desirable to have a MOS current source with a low temperature coefficient that does not rely solely on a resistor for temperature stability.

It is also desirable for the low temperature coefficient current reference to be implementable solely in an integrated circuit.

SUMMARY OF THE INVENTION

These and other aspects of the invention may be obtained generally in an integrated circuit current reference for producing a substantially constant current to an output and having first and second different potential references. The current reference is characterized by: a series coupled switched capacitor having a first terminal and a second terminal; a storage capacitor having a first terminal connected to the output of the current reference; and an amplifier having an input, connected to the output of the reference, and an output. The first terminal of the switched capacitor is alternatively switched between the first and second references, and the second terminal of the switched capacitor is alternatively switched between the output of the amplifier and the output of the current reference.

BRIEF DESCRIPTION OF THE DRAWING

The foregoing features of this invention, as well as the invention itself, may be more fully understood from the following detailed description of the drawings, in which.

DETAILED DESCRIPTION

Figure 1:
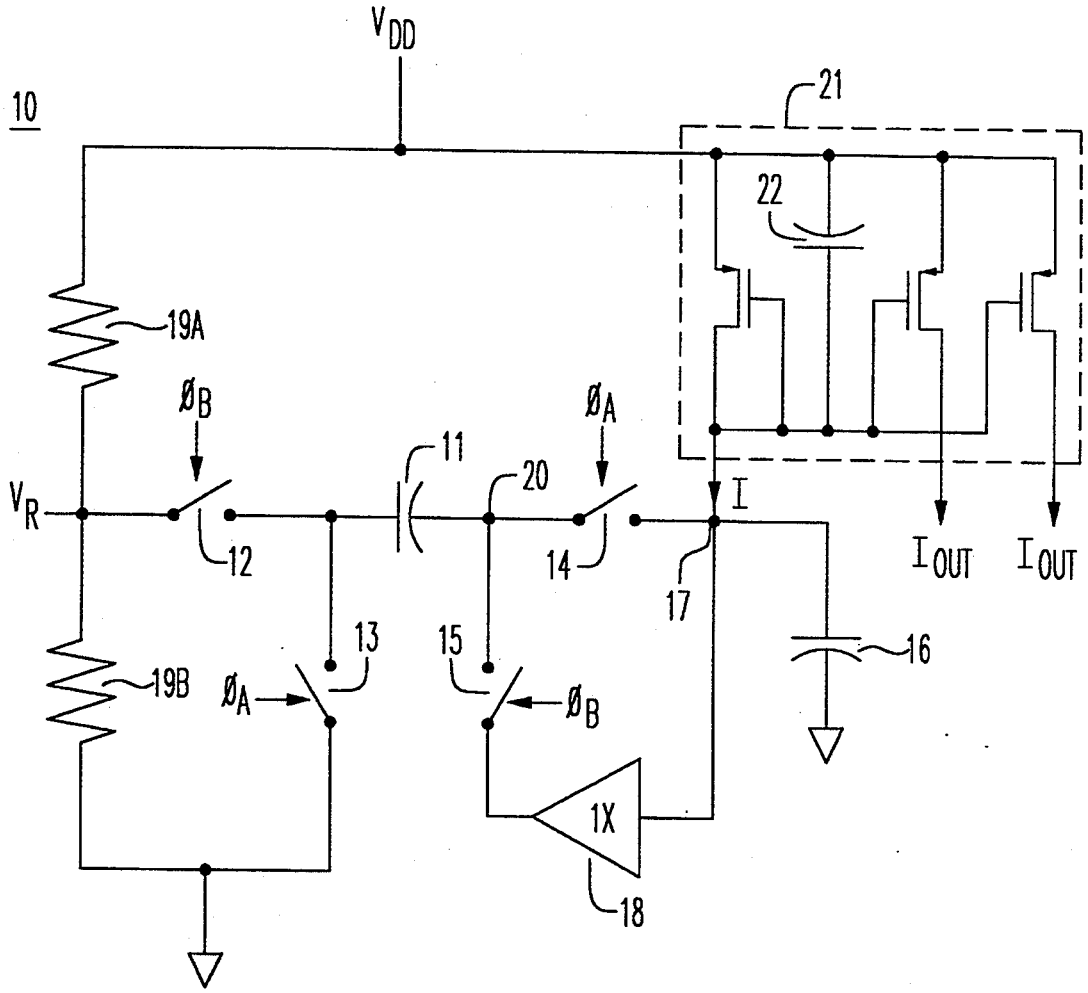
FIG. 1 is a simplified schematic diagram of an embodiment of the invention.

In FIG. 1, the exemplary embodiment of the invention is shown. The current reference circuit 10 is preferably formed in an integrated circuit and produces a substantially constant output current I. Two potential references are provided, $V_R$ and ground. A series coupled switched capacitor 11 has two terminals, one terminal is connected to the common junction of switches 12 and 13. The second terminal of capacitor 11 is connected to the common junction of switches 14 and 15. A storage capacitor 16 has a terminal connected to the output terminal 17 of the current reference 10 and another terminal connected to ground. An amplifier 18, here a unity gain buffer, has an input connected to terminal 17 and an output connected to switch 15. Switch 14 also connects to node 17. Operationally, the first terminal of the switched capacitor 11 is alternatively switched between ground and the reference $V_R$ by switches 12 and 13. The second terminal of the switched capacitor 11 is alternatively switched between the output of the buffer 18 and the output terminal 17 of the current reference 10 by switches 14 and 15.

Figure 2:
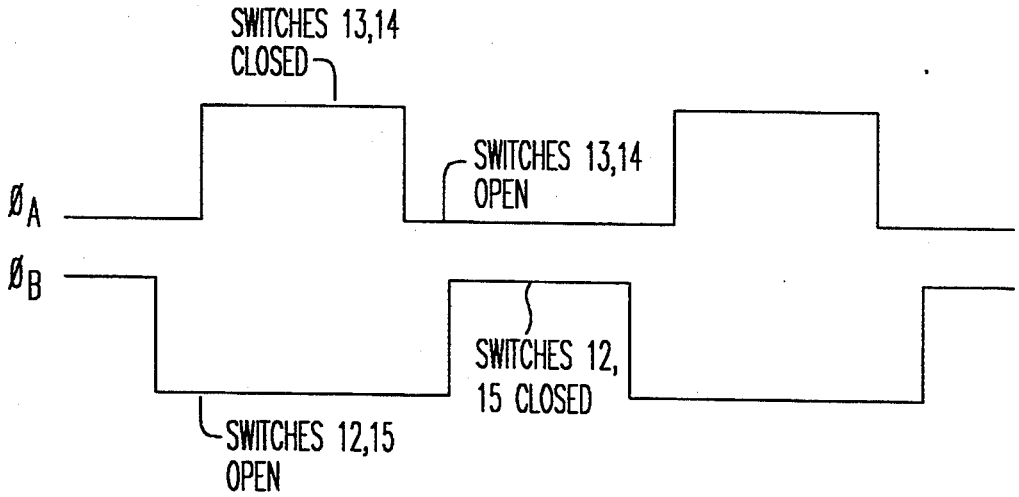
FIG. 2 is an illustrative example (not to scale) of the clock signals used in FIG. 1.

The switches 13 and 14 are commonly controlled by a clock signal $\phi_A$ and switches 12 and 15 are commonly controlled by a clock signal $\phi_B$. The clock signals are non-overlapping, i.e., switches 12, 15 and 13, 14 are not simultaneously closed. The clock signals are illustrated in FIG. 2 (not to scale), the frequency of which is discussed below. As shown, when the clock signal is "high", the corresponding switches 12–15 are closed.

Returning to FIG. 1, the operation of the current reference is described herein. For purposes of this discussion, the reference $V_R$ is invariant and has very low impedance, as will be discussed below. Further, the capacitance of storage capacitor 16 includes stray and additional capacitances such that the capacitance thereof is much greater than the capacitance of capacitor 11. In addition, the time constant formed by the resistance presented by a load on the output of the current reference and the sum of the capacitances 11, 16 is much longer than the period of the clock signals. This makes the output current I substantially clock-ripple free. The temperature coefficient of the capacitors 11, 16 are not critical since they are formed in the same substrate. However, capacitor 11 should be as temperature invariant and as precise as possible, such as a metal-metal or a poly-metal capacitor. The characteristics of the capacitor 11 substantially affects the accuracy and the temperature dependence of the current reference 10.

The output current I is proportional to the frequency of the clock signals $\phi_A$, $\phi_B$, the capacitance of capacitor 11, and the reference voltage $V_R$. This is comes from the switching of capacitor 11 between ground the $V_R$ to subtract charge from the capacitor 16 during each clock cycle which is replaced by the output current I. More specifically, node 20 is kept at substantially the same voltage as terminal 17 by switch 14 being closed or by buffer 18 when switch 15 is closed. As the switches 12–15 are clocked, the capacitor 11 is charged from capacitor 16 when switches 13 and 14 are closed and then discharged by the buffer 18 through the reference voltage source $V_R$ when switches 12 and 14 are closed. The amount of charge is approximately $V_R$ times the capacitance of capacitor 11. Since the amount of charge is proportional to the rate capacitor 11 is switched, the output current I is then approximately $fC_{11}V_R$ where f is the frequency of the clock signals $\phi_A$, $\phi_B$ and $C_{11}$ is the capacitance of capacitor 11. $V_R$ is the voltage of the reference voltage as measured from ground. If, however, a voltage other than ground (zero volts) is used, $V_R$ represents the difference in the voltage that capacitor 11 is switched between by switches 12, 13.

The output current I is then mirrored by current mirror 21 to provide multiple bias currents if needed. The resistance of the mirror 21 as a load to the current reference 10 is approximately the reciprocal of the transconductance of the diode-connected transistor therein. Further, capacitor 22 is added to reduce clock ripple and power supply ($V_{DD}$) noise on the current from the mirror 21 by being effectively paralleled with capacitor 16. As discussed above, the value of capacitor 16 is not critical and for purposes of the invention, includes parasitic capacitances (e.g., the gate capacitances in the current mirror 21) and filter capacitor 22. Other types of current mirrors may be used, such as compound current mirrors.

The reference voltage $V_R$ is generated by voltage divider resistors 19A, 19B powered from the supply voltage rail $V_{DD}$. In the below example, the voltage on $V_R$ is approximately one-fifth $V_{DD}$. The combined resistances of resistors 19A, 19B should be low enough such that capacitor 11 is fully charged to $V_R$ during the time that switch 12 is closed. Further, other methods may be provided to generate $V_R$, such as a band-gap reference, if more tolerance to power supply variations is desired.

Exemplary Results

A 20 μA, 150 ppm/° C. current reference has been fabricated with the following exemplary component values:

| | |
|---|---|
| capacitor 11 | 2 pF |
| capacitor 16 (inc. cap. 22) | 20 pF |
| resistors 19A, 19B | 4KΩ, 1KΩ |
| clock frequency | 10 MHz |

Having described the preferred embodiment of this invention, it will now be apparent to one of skill in the art that other embodiments incorporating its concept may be used. Therefore, this invention should not be limited to the disclosed embodiment, but rather should be limited only by the spirit and scope of the appended claims.

I claim:

1. In an integrated circuit, a current reference for producing a substantially constant current I to an output and having first and second different potential references, CHARACTERIZED BY:

a series coupled switched capacitor having a first terminal and a second terminal;

a storage capacitor having a first terminal connected to the output of the current reference; and a non-inverting buffer amplifier having an input connected to the output of the current reference, and an output;

wherein the first terminal of the switched capacitor is alternatively switched between the first and second voltage references, and the second terminal of the switched capacitor is alternatively switched between the output of the amplifier and the output of the current reference.

2. The current reference of claim 1, wherein the capacitance of storage capacitor is larger than the capacitance of the switched capacitor to make the output current substantially independent of the capacitance of the storage capacitor.

3. The current reference of claim 2, further characterized by: first and second series-coupled resistors connected between a power supply rail and the second potential reference, the juncture of the resistors being the first potential reference.

4. The current reference of claim 3, further characterized by the storage capacitor having a second terminal connected to the second reference potential, wherein the second potential reference is ground.

5. The current reference of claim 4, further characterized by: a current mirror means having an input an at least one output, the input connected to the output of the current reference.

6. In an integrated circuit, a current reference for producing a substantially constant current I to an output and having first and second different potential references, CHARACTERIZED BY:

a first capacitor having first and second terminals;

a second capacitor having a first terminal connected to the output of the current reference;

a non-inverting buffer amplifier having an input coupling to the first terminal of the second capacitor;

a first switch connecting between the first voltage reference and the first terminal of the capacitor;

a second switch connecting between the second voltage reference and the first terminal of the capacitor;

a third switch connecting between the second terminal of the first capacitor and the first terminal of the second capacitor; and a fourth switch connecting between the amplifier output and the second terminal of the first capacitor;

wherein the first and third switches are switched oppositely from the second and fourth switches.

7. The current reference of claim 6, wherein the capacitance of second capacitor is larger than the capacitance of the first capacitor to make the output current substantially independent of the capacitance of the second capacitor.

8. The current reference of claim 7, further characterized by: first and second series-coupled resistors connected between a power supply rail and the second potential reference, the juncture of the resistors being the first potential reference.

9. The current reference of claim 8, further characterized by the second capacitor having a second terminal connected to the second reference potential, wherein the second potential reference is ground.

10. The current reference of claim 9, further characterized by: a current mirror means having an input an at least one output, the input connected to the output of the current reference.

* * * * *